US007653338B2

(12) United States Patent
Kim et al.

(10) Patent No.: US 7,653,338 B2
(45) Date of Patent: Jan. 26, 2010

(54) FUSING UNIT AND IMAGE FORMING APPARATUS INCLUDING THE SAME

(75) Inventors: Jong-oh Kim, Seoul (KR); Hwen-guem Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 11/858,464

(22) Filed: Sep. 20, 2007

(65) Prior Publication Data

US 2008/0124148 A1 May 29, 2008

(30) Foreign Application Priority Data

Nov. 29, 2006 (KR) ..... 10-2006-0119217

(51) Int. Cl.
*G03G 15/20* (2006.01)

(52) U.S. Cl. ..... 399/330; 219/216; 399/328

(58) Field of Classification Search ..... 399/328, 399/329, 330, 333, 334; 219/216; 347/156; 118/60; 432/60
See application file for complete search history.

(56) References Cited

U.S. PATENT DOCUMENTS 3,452,181 A * 6/1969 Stryjewski ..... 219/216
6,839,538 B1 * 1/2005 Gonzalez et al. ..... 219/216 X
7,177,579 B2 * 2/2007 Uchida et al. ..... 399/328
7,460,822 B2 * 12/2008 Potter et al. ..... 399/330
2005/0265758 A1 12/2005 Haseba et al. ..... 399/329
2006/0177251 A1 * 8/2006 Uehara et al. ..... 399/329
2006/0204266 A1 9/2006 Watabe ..... 399/69
2006/0289418 A1 * 12/2006 Konishi et al. ..... 219/216

FOREIGN PATENT DOCUMENTS

JP 2002-108119 4/2002
JP 2003-162169 6/2003
JP 2003-223064 8/2003
JP 2004-101731 4/2004
JP 2007-026792 A * 2/2007

OTHER PUBLICATIONS

Office Action issued in corresponding European Patent Application No. 07114631.0 dated Mar. 17, 2008.

* cited by examiner

*Primary Examiner*—Sophia S Chen
(74) *Attorney, Agent, or Firm*—Stein McEwen, LLP

(57) ABSTRACT

A fusing unit of an image forming apparatus, includes: a heating lamp having a heating unit, and a tubular unit accommodating the heating unit; a heating roller accommodating the heating lamp; and a pressing roller to be pressed toward the heating roller; the tubular unit includes a reflecting film formed on at least one of an external circumference surface and an internal surface thereof so as to have a different reflectivity along a lengthwise direction of the heating unit.

21 Claims, 18 Drawing Sheets

FUSING UNIT AND IMAGE FORMING APPARATUS INCLUDING THE SAME

CROSS-REFERENCE TO RELATED APPLICATION

This application claims priority from Korean Patent Application No. 2006-119217, filed on Nov. 29, 2006 in the Korean Intellectual Property Office, the disclosure of which is incorporated herein by reference.

BACKGROUND OF THE INVENTION

1. Field of the Invention

An aspect of the present invention relates to a fusing unit and an image forming apparatus, and more particularly, to a fusing unit and an image forming apparatus for reducing a material cost and improving a fixation property.

2. Description of the Related Art

As shown in FIG. 1, a conventional fusing unit includes a heating lamp 10, a heating roller 20 and a pressing roller 30. The heating lamp 10 is located inside the heating roller 20 and the heating lamp 10 generates heat. Also, the pressing roller 30 includes an elastic member (see 137 in FIG. 4) which pushes the pressing roller 30 toward the heating roller 20. A location E in which the heating roller 20 and the pressing roller 30 engage each other, is referred to as 'a fusing nip'. A fluid developer T adhered to a printing medium P through electrifying-exposing-developing-transferring processes passes through the fusing nip E and is fused onto the printing medium P.

As illustrated in FIG. 2, the heating lamp 10 includes a tubular unit 13 made of a transparent glass wrapping a heating unit 11 that includes a tungsten filament. On an external circumference of the tubular unit 13 a reflecting film 15 is formed. The reflecting film 15 reflects heat (more precisely, infrared rays) generated by the heating unit 11. The heat is generated by an electric current applied through an electrode brush 17 onto the fusing nip E.

FIGS. 3A-3C are graphs illustrating relationships among distributions of pressure in the fusing nip E, heat flux at the fusing nip transmitted from the heating lamp 10 and the fixation property along the lengthwise direction of the heating roller 20 in the fusing unit in FIG. 1 (in a perpendicular direction with respect to the paper in FIG. 1).

As illustrated in FIG. 3A, the pressure of the fusing nip E is smaller in a center part A than in opposite end parts B in the lengthwise direction of the heating lamp 10. As illustrated in FIG. 3B, the heat flux distribution from the heating lamp 10 to the fusing nip is uniform in the lengthwise direction of the heating lamp 10 when the reflecting film 15 is uniformly formed on the tubular unit 13. As illustrated in FIG. 3C, the fixation property of the center part A is much inferior to the fixation property of the opposite end parts B.

The reference fixation property illustrated in FIG. 3C determines the quality of the fusing unit. If the fixation property at a center part A of the tubular unit 13 differs substantially from the fixation property at an end part B, the fusing unit is determined to be of poor quality. Accordingly, the reflecting film 15 is mainly formed so as to increase the heat flux of the heating lamp 10 to the fusing nip E so that the fixation property of the center part A does not differ from the fixation property at an end part B.

However, the conventional heating lamp 10 is inefficient even if the reflecting film 15 is uniformly formed on the tubular unit 13, if the pressure distribution along the lengthwise direction of the fusing nip E is not considered. Accordingly, a material cost of the apparatus rises and the fixation property deviation between the center part A and the opposite end part B is not corrected, thereby generating an inferior image.

SUMMARY OF THE INVENTION

Accordingly, it is an aspect of the present invention to provide a fusing unit and an image forming apparatus which can save a material cost, and decrease a fixation property deviation along a lengthwise direction of a tubular unit.

According to another aspect of the present invention, there is provided a fusing unit of an image forming apparatus, including: a heating lamp having a heating unit, and a tubular unit accommodating the heating unit; a heating roller accommodating the heating lamp; and a pressing roller to be pressed toward the heating roller; the tubular unit including a reflecting film formed on at least one of an external surface and an internal surface thereof so as to deflect heat along a lengthwise direction of the heating unit.

According to an aspect of the invention, the reflecting film is formed so that its reflectivity can be inversely proportional to a pressure of the pressing roller against the heating roller.

According to an aspect of the invention, the reflecting film is formed to have a different thickness along the lengthwise direction of the heating unit.

According to an aspect of the invention, the thickness of the reflecting film is inversely proportional to the pressure of the pressing roller against the heating roller.

According to an aspect of the invention, the reflecting film is formed to have a different reflecting area along the lengthwise direction of the heating unit.

According to an aspect of the invention, the reflecting area is inversely proportional to the pressure of the pressing roller against the heating roller.

According to an aspect of the invention, the reflecting film includes a heat absorption material which absorbs heat of the heating unit and a reflecting material which reflects heat of the heating unit, and the ratio of the heat absorption material with respect to the reflecting material is provided to be different along the lengthwise direction of the tubular unit.

According to an aspect of the invention, the density of the heat absorption material is in proportion to the pressure of the pressing roller against the heating roller.

According to an aspect of the invention, the reflecting film is formed so that the heat rays of the heating unit can be reflected toward a part of an inside circumference surface of the heating roller before the part rotates to a position in which the pressing roller and the heating roller are engaged.

According to an aspect of the invention, the reflecting film is formed to be coated with a reflecting material.

The foregoing and/or other aspects of the present invention can be achieved by providing an image forming apparatus, including: an image forming unit which forms an image on a printing medium; a fusing unit to fuse a developer having a heating lamp including a heating unit and a tubular unit accommodating the heating unit, a heating roller accommodating the heating lamp, and a pressing roller to be pressed toward the heating roller; and the tubular unit including a reflecting film formed on at least one of an external surface and an internal surface thereof so as to reflect heat rays generated by the heating unit along a lengthwise direction of the heating unit.

According to an aspect of the invention, the reflecting film is formed so that the reflectivity can be in inverse proportion to the pressure of the pressing roller against the heating roller.

According to an aspect of the invention, the reflecting film is formed to have a different thickness along the lengthwise direction of the heating unit.

According to an aspect of the invention, the thickness of the reflecting film is in inverse proportion to the pressure of the pressing roller against the heating roller.

According to an aspect of the invention, the reflecting film is formed to have a different reflecting area along the lengthwise direction of the heating unit.

According to an aspect of the invention, the area of the reflecting film is in inverse proportion to the pressure of the pressing roller against the heating roller.

According to an aspect of the invention, the reflecting film includes a heat absorption material which absorbs heat of the heating unit and a reflecting material which reflects heat of the heating unit, and the ratio of the heat absorption material with respect to the reflecting material is provided to be different along the lengthwise direction of the tubular unit.

According to an aspect of the invention, the density of the heat absorption material is in proportion to the pressure of the pressing roller against the heating roller.

According to an aspect of the invention, the reflecting film is formed so that the heat rays of the heating unit can be reflected toward a part of an inside circumference surface of the heating roller before the part rotates to a position in which the pressing roller and the heating roller are engaged.

According to an aspect of the invention, the reflecting film is coated with a reflecting material.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
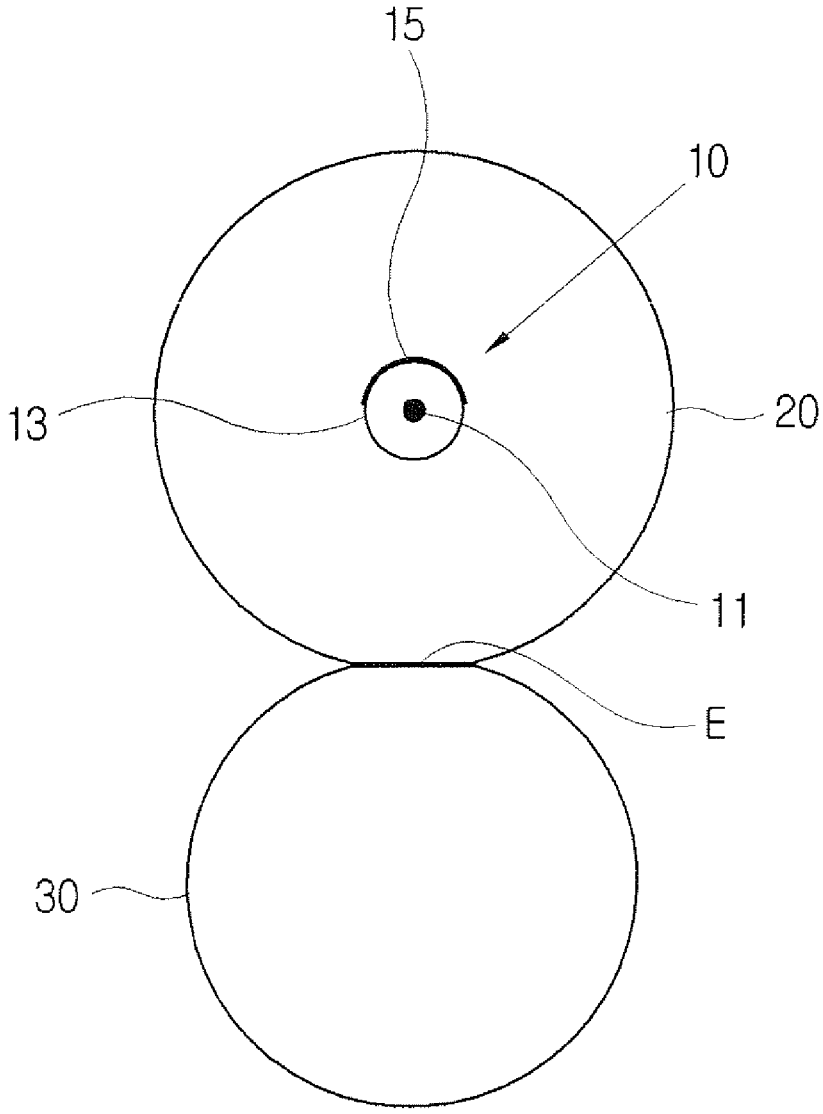
FIG. 1 (RELATED ART)
FIG. 1 is a plane view of a conventional fusing unit.
Figure 2:
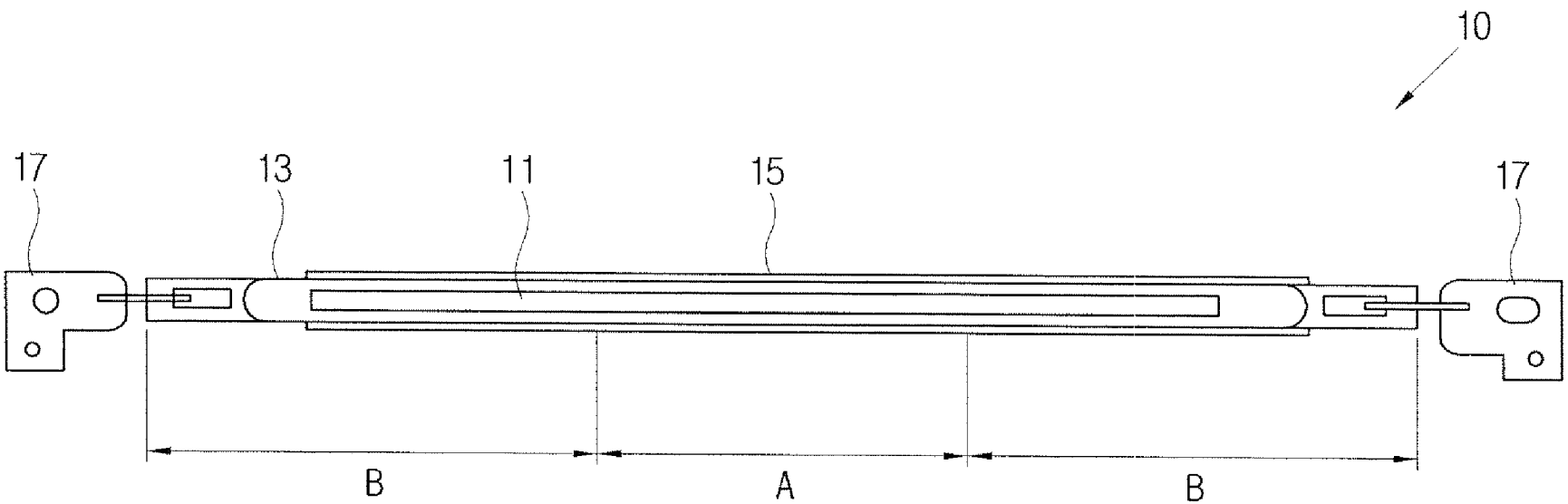
FIG. 2 (RELATED ART)
FIG. 2 is a sectional view of the heating lamp in FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
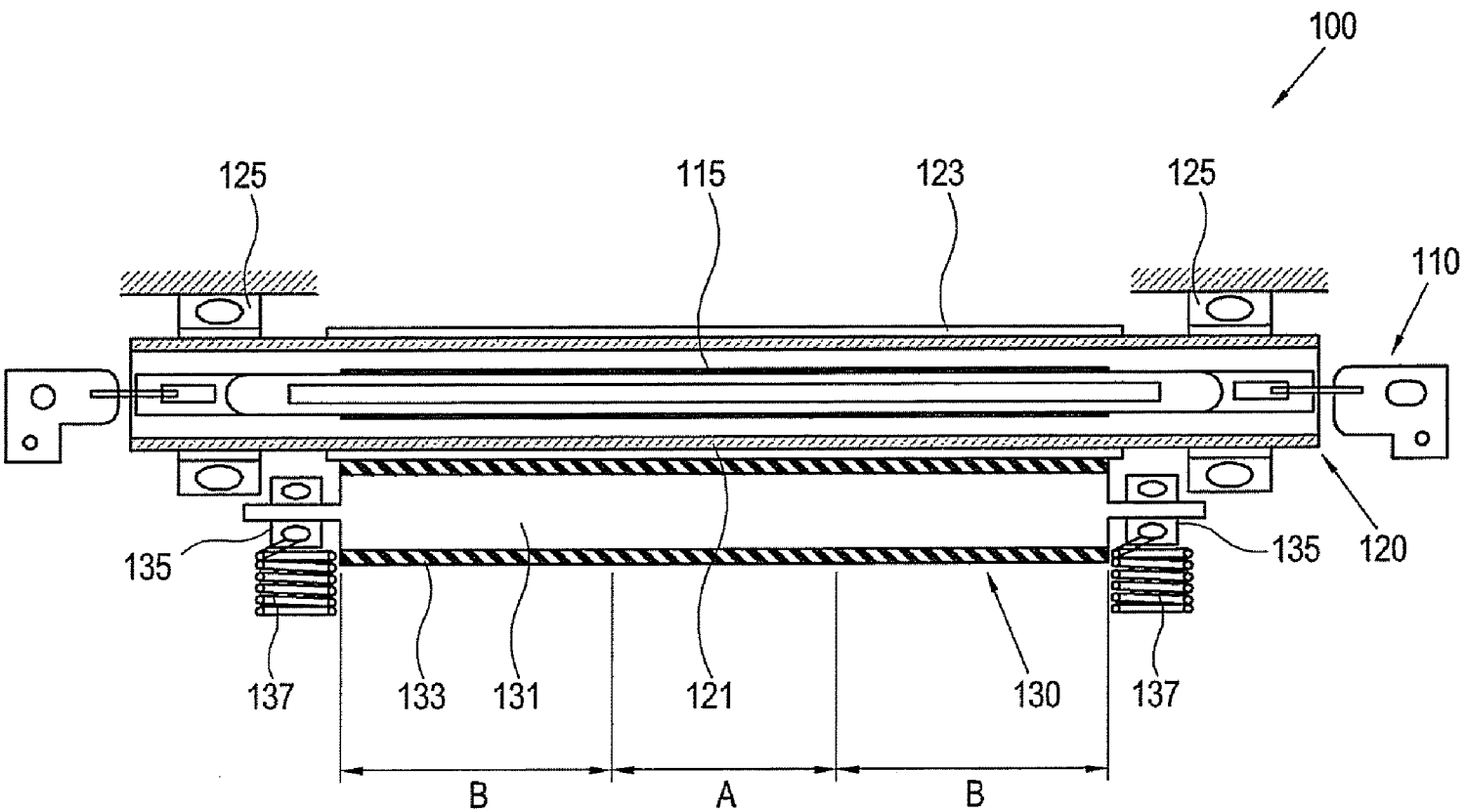
FIG. 4 is a cross sectional view of a fusing unit according to an embodiment of the present invention.

As shown in FIG. 4, the fusing unit 100 according to an embodiment of the present invention includes a heating lamp 110, a heating roller 120, and a pressing roller 130. The heating roller 120 includes a rotating body 121 accommodating the heating lamp 110 to be described later. The rotating body 121 is provided as a cylindrical metal body formed of material such as aluminum and its opposite end parts are rotationally supported by a bearing 125. Also, a coating layer 123 is formed to wrap an external circumference surface of the rotational body 121.

The pressing roller 130 has a cylindrical rod 131 made of material such as aluminum or stainless steel, and opposite end parts of the rod 131 are rotationally supported by the bearing 135. On an external circumference surface of the rod 131 an elastic body layer 133 is formed, and the elastic body layer 133 may be formed of material such as silicon rubber or urethane having the thickness of 300 μm~5 mm.

Figure 5:
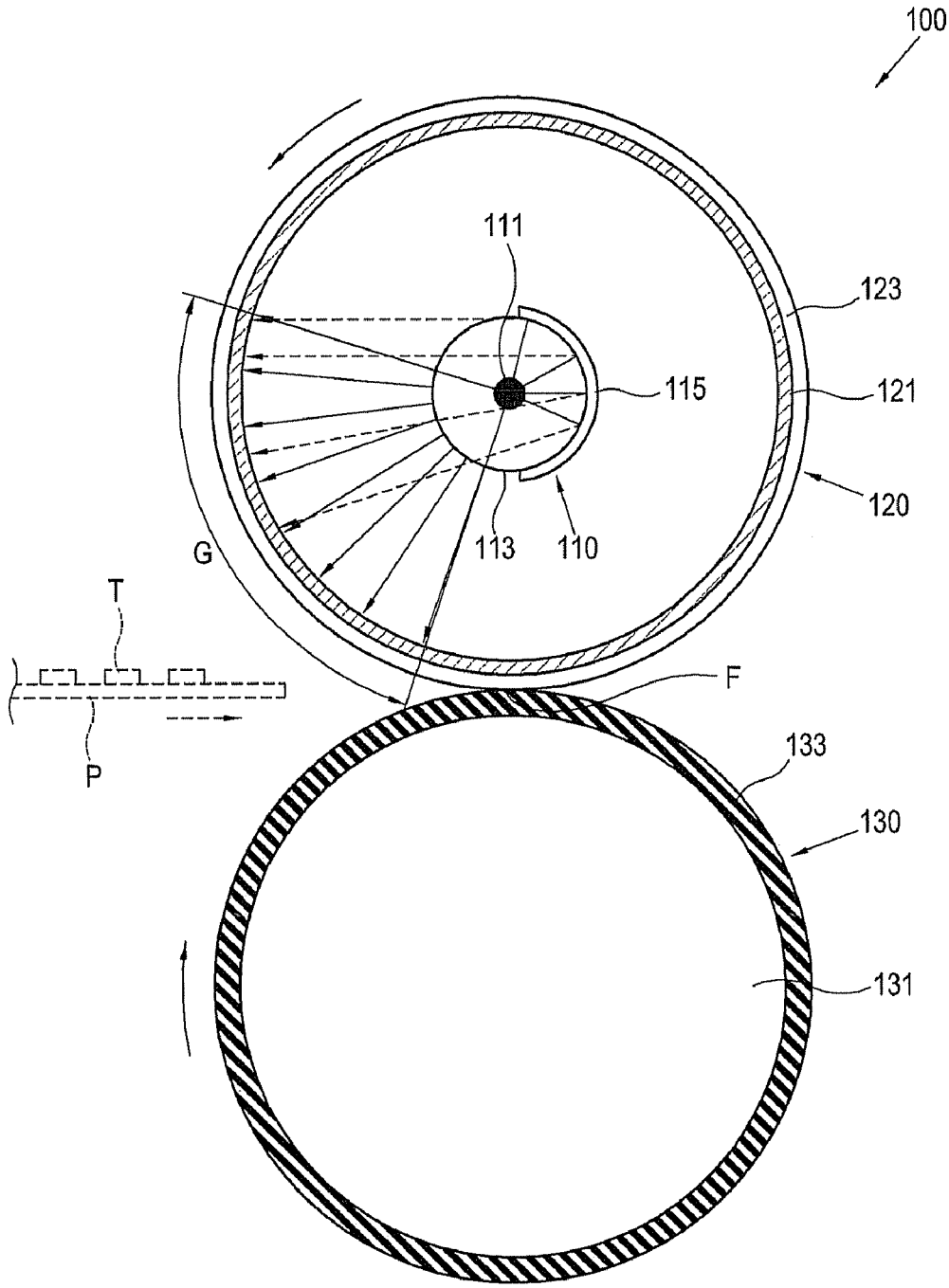
FIG. 5 is a sectional view of the fusing unit in FIG. 4.
Figure 6:
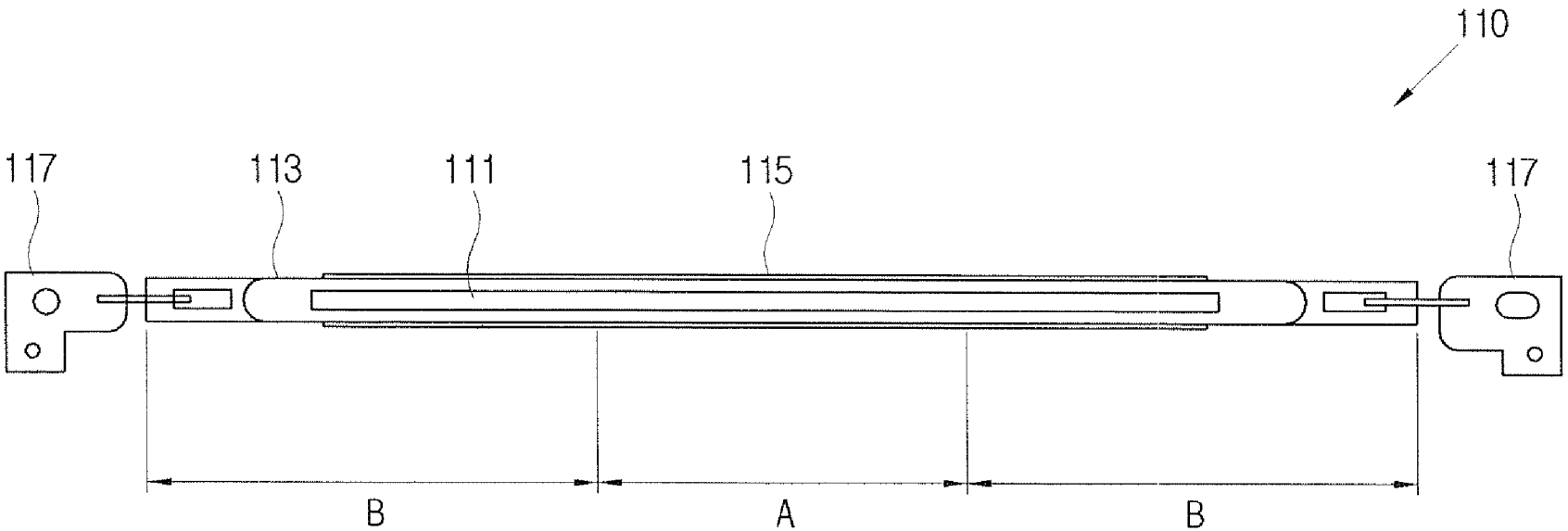
FIG. 6 is a plane view of a heating lamp of the fusing unit in FIG. 4.

As shown in FIGS. 5 and 6, the heating lamp 110 includes a heating unit 111 which is provided with a filament such as tungsten, a tubular unit 113 accommodating the heating unit 111, and a reflecting film 115 which is provided on an external circumference surface of the tubular unit 113. On opposite end parts of the tubular unit 113 an electrode brush 117 is provided (see FIG. 6) for supplying power to the heating unit 111.

The tubular unit 113 is formed of transparent glass so that radiant heat generated by the heating unit 111 can pass through the tubular unit 113, and in the tubular unit 113 a halogen material such as, bromine or iodine, may be injected to suppress evaporation of the tungsten filament.

The reflecting film 115 may be provided as a coating layer formed by coating a reflecting material on the external circumference surface of the tubular unit 113, or by adhering the reflecting film 15. Gold, silver, and aluminum are used for the reflecting material.

The reflecting film 115 reflects heat rays (or infrared rays) from the heating unit 111 and enables a specific area of the heating roller 120 to be intensively heated. The reflecting film 115 has different reflectivity along the lengthwise direction of the tubular unit 113. That is, since the heating unit 111 is a linear light source, the heat is radiated to an omni-direction from 0 to 360 degrees about the center heating unit 111 in the sectional surface in FIG. 5. The reflecting film 115 is formed so that the ratio of the heat rays reflected from the reflecting film 115, excluding the heat rays transmitted by the tubular unit 113, can be changed along the lengthwise direction of the tubular unit 113.

Also, the reflecting film 115 may be provided so as to have different reflectivities along the lengthwise direction of the tubular unit 113 so that the heat flux distribution of the heating lamp 110 with the differently provided reflectivity can offset a pressure distribution along the lengthwise direction of the fusing nip (see F in FIG. 5). Accordingly, the fixation deviation along the lengthwise direction of the fusing unit 100 is decreased. That is, in a part having the relatively high fusing nip pressure, the reflectivity of the reflecting film 115 is lowered, and in a part having a low pressure, the reflectivity of the reflecting film 115 is raised. Also, the heat flux is increased in the part having the lower fusing nip pressure, thereby decreasing the deviation of the fixation property along the lengthwise direction.

Figure 3A:
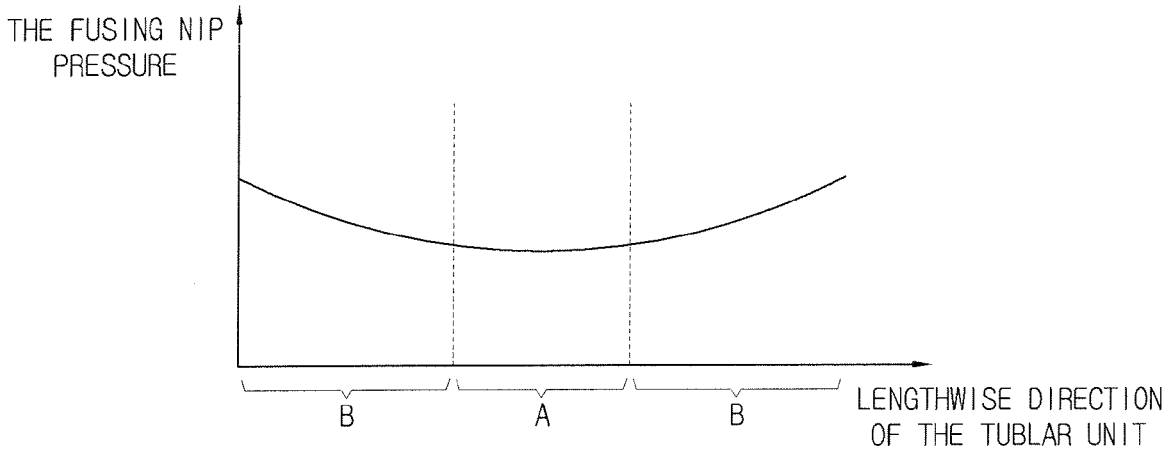
FIG. 3A (RELATED ART)
FIGS. 3A-3C are graphs illustrating pressure of a fusing nip, heat flux at the fusing nip transmitted from a heating lamp and their effects on a fixation property along the lengthwise direction of a heating roller of the fusing unit in FIG. 1.
Figure 3B:
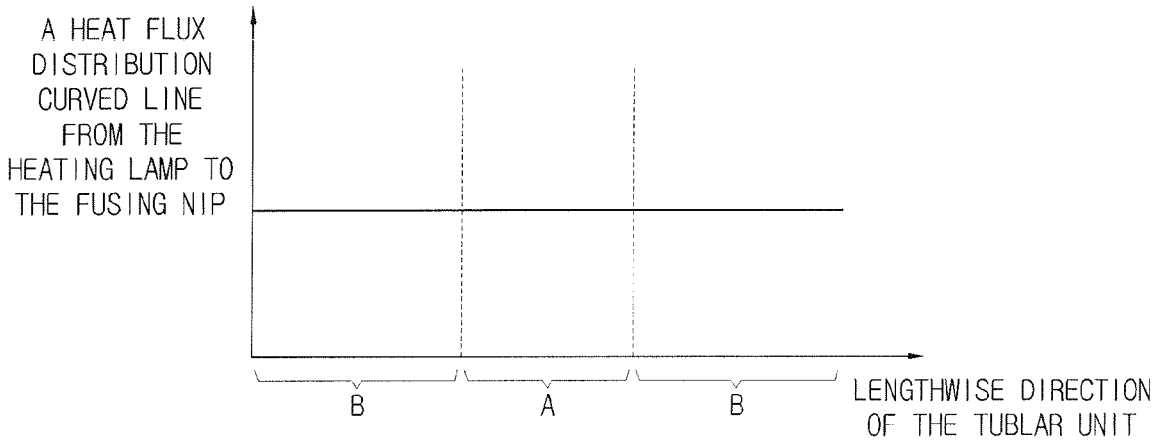
FIG. 3B (RELATED ART)
Figure 3C:
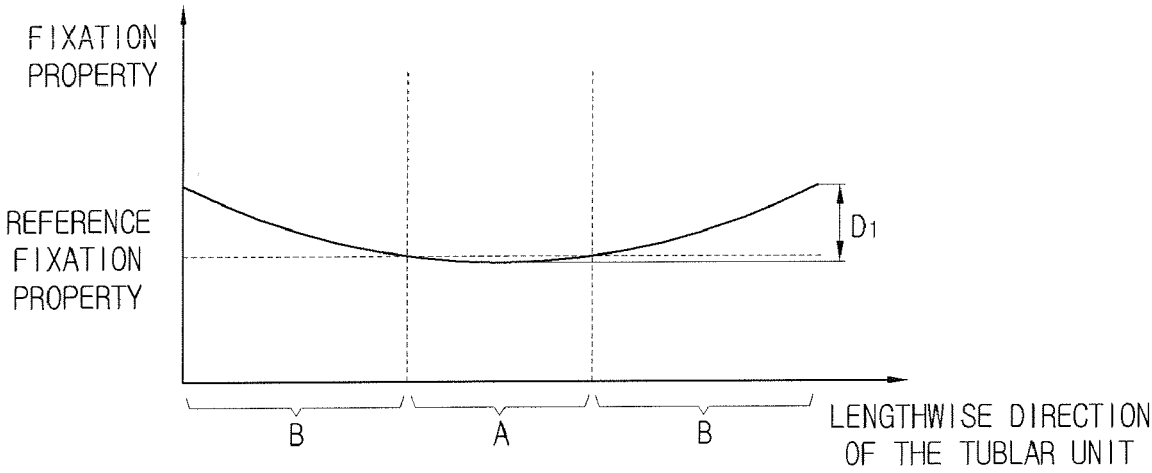
FIG. 3C (RELATED ART)

The reflectivity of the center part A having the low fusing nip pressure is raised and the reflectivity of the opposite end parts B having a relatively high pressure is lowered in the above-described FIG. 3.

Figure 7:
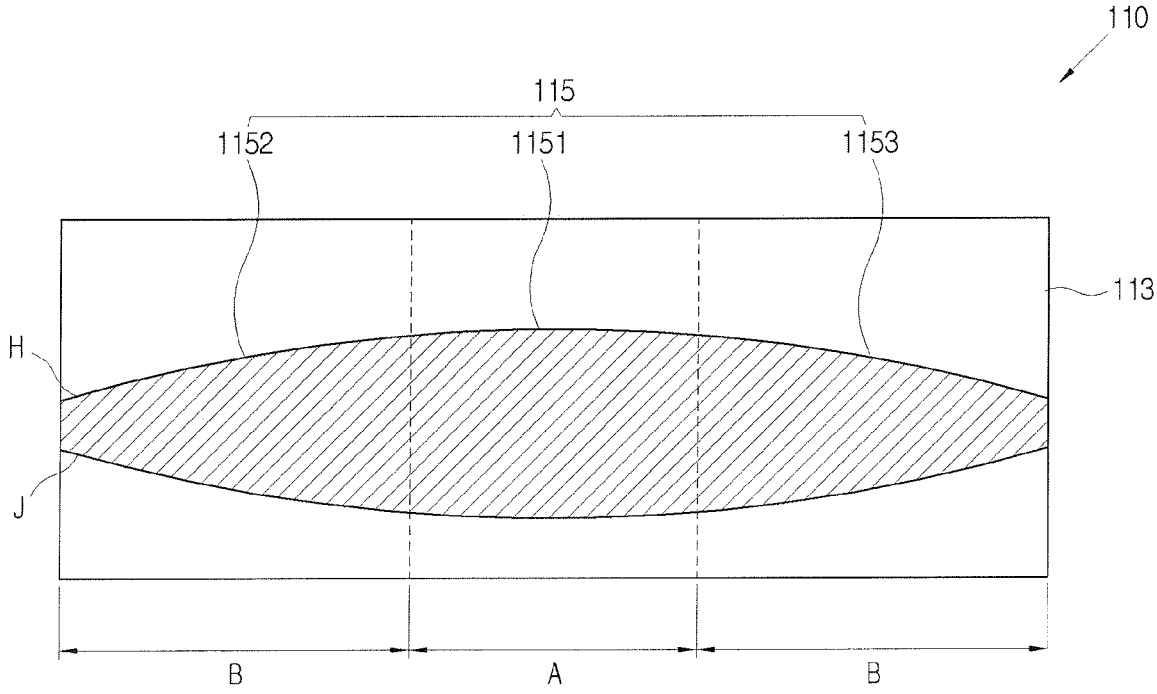
FIG. 7 is a development view of a tubular unit of the heating lamp in FIG. 6.
Figure 8:
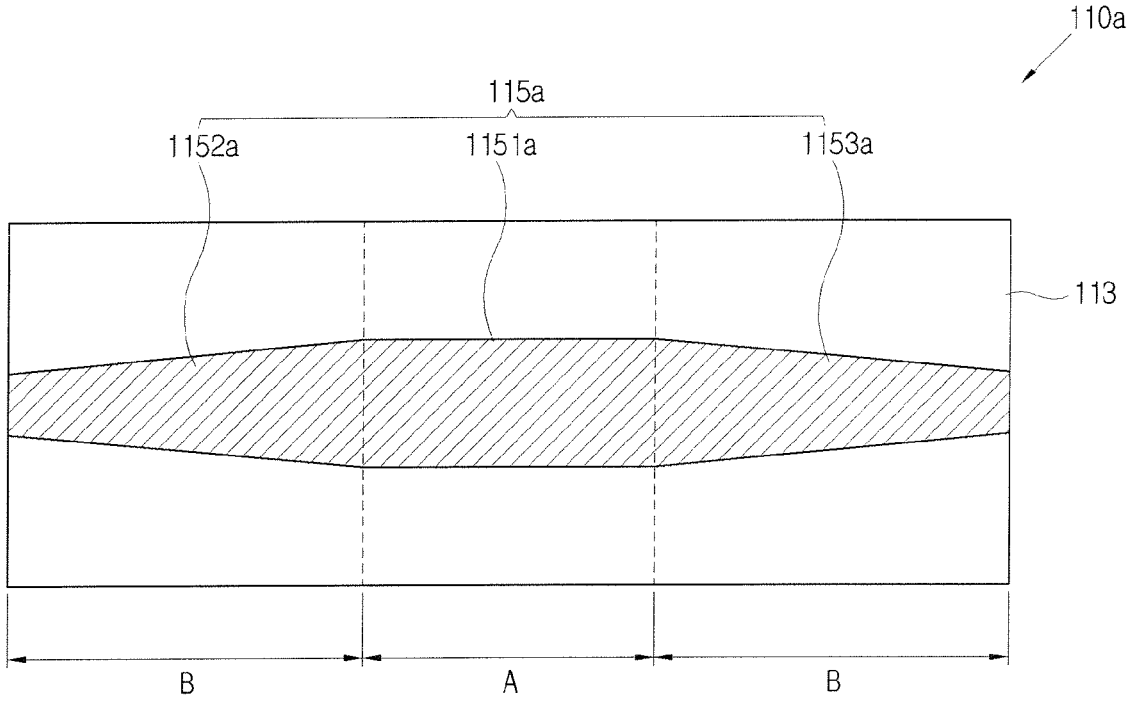
FIG. 8 is a development view of the tubular unit having a varied area pattern in a reflecting film in FIG. 7.

FIG. 7 is a development view of the tubular unit 113 provided with a uniformly formed reflecting film 115, and FIG. 8 illustrates a reflecting film 115*a* having a somewhat varied area pattern in the reflecting film 115 in FIG. 7.

As shown in FIGS. 7 and 8, the reflectivity along the lengthwise direction of the tubular unit can be controlled by changing the shape of the area of the reflecting film 115 along the lengthwise direction. As shown in FIG. 7, the areas of the reflecting film 1151, 1152 and 1153 can be provided so as to be a pattern between an upper boundary line H and a lower boundary line J. The area pattern of the reflecting film 115, including areas 1151, 1152 and 1153 may be provided so that the reflectivity along the lengthwise direction of the fusing unit 100 is in inverse proportion to the pressure distribution of the fusing nip which is measured experimentally (refer to "the fusing nip pressure" distribution curved line in FIG. 11).

Here, the upper boundary line H is illustrated as a bulging curved line in the centering part A, and the lower boundary line J is illustrated as a recessed curved line in the centering part A. Also, the upper and the lower boundary lines H and J may be provided to be symmetrical to each other with respect to the centering line of the tubular unit 113. Accordingly, an optimum heat flux distributing curved line can be obtained to offset the pressure distribution of the fusing nip E shown in FIGS. 3 and 11. An effect on the fixation property according to the result will be described later.

Meanwhile, a reflecting film 115*a* of the heating roller 110*a* may be formed so that the area of the reflecting film 115*a* can be like the pattern illustrated in FIG. 8. That is, the area of the reflecting film 1151*a* of the center part A is uniform while the area of the reflecting films 1152*a* and 1153*a* of the opposite end parts B are decreased as they get close to the opposite end parts B. Accordingly, a production cost and the number of operating processes can be decreased in comparison with forming the reflecting film 115 having the area pattern illustrated in FIG. 7. It is noted that the area pattern illustrated in FIGS. 7 and 8 denotes only an example, and it may be changed in consideration of the measured pressure of the fusing nip and the number of the operating processes.

As shown in FIG. 5, the reflecting film 115 may be formed to reflect the heat rays of the heating unit 111 toward an area G of the heating roller 120 before passing through the fusing nip F. Such reflection may be provided by disposing the reflecting film 115 in a position that the reflecting film 115 can face the area G of the heating roller 110 with respect to the heating unit 111. Accordingly, the heat rays (a full linear arrow) having passed through the tubular unit 113 and the heat rays (a dotted-line arrow) reflected back to the reflecting film 115 are superimposed with each other, thereby rapidly preheating the surface of the heating roller 120.

Figure 9:
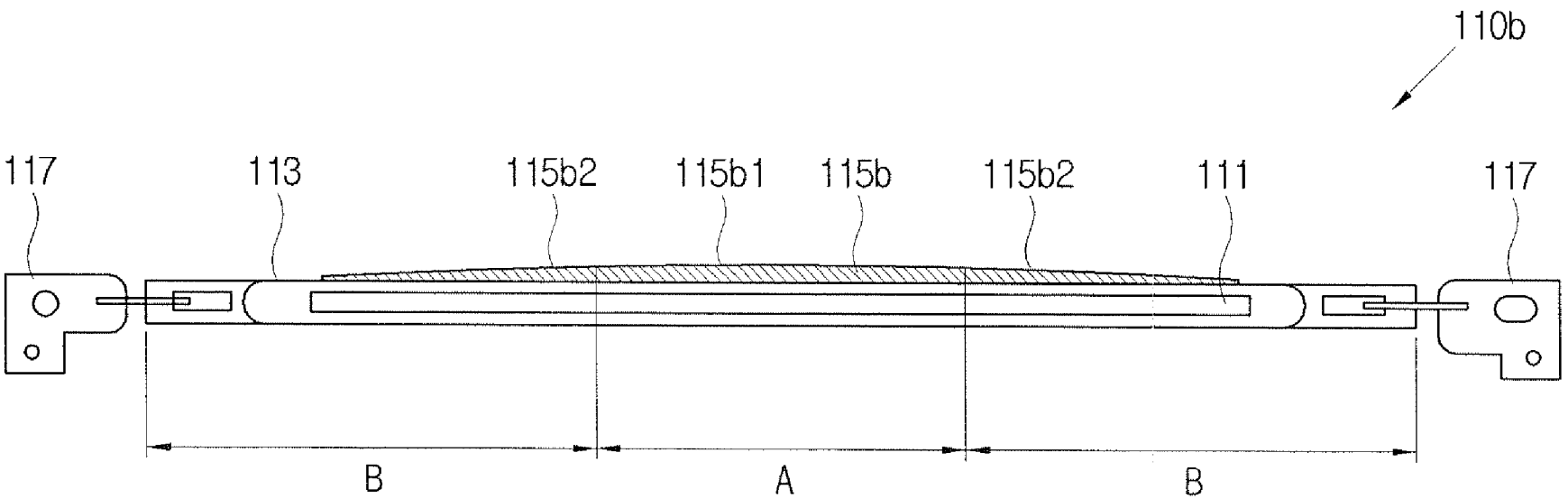
FIG. 9 is a plane view of the heating lamp of a fusing unit according to another embodiment of the present invention.

FIG. 9 illustrates a fusing unit according to another exemplary embodiment of the present invention includes a heating lamp 110*b*. The description of the other components of the fusing unit will be omitted as they are the same as those already explained.

The area of the tubular unit 113 that the reflecting films 115 and 115*a* cover is changed along the lengthwise direction in one of the embodiments of the present invention, but a reflectivity of the reflecting film 115*b* may be changed along the lengthwise direction by controlling the thickness of the reflecting film 115*b* in another embodiment. That is, the thickness of the reflecting film 115*b*1 of a center part A may be thicker than that of the reflecting film 115*b*2 of opposite end parts B.

Figure 10:
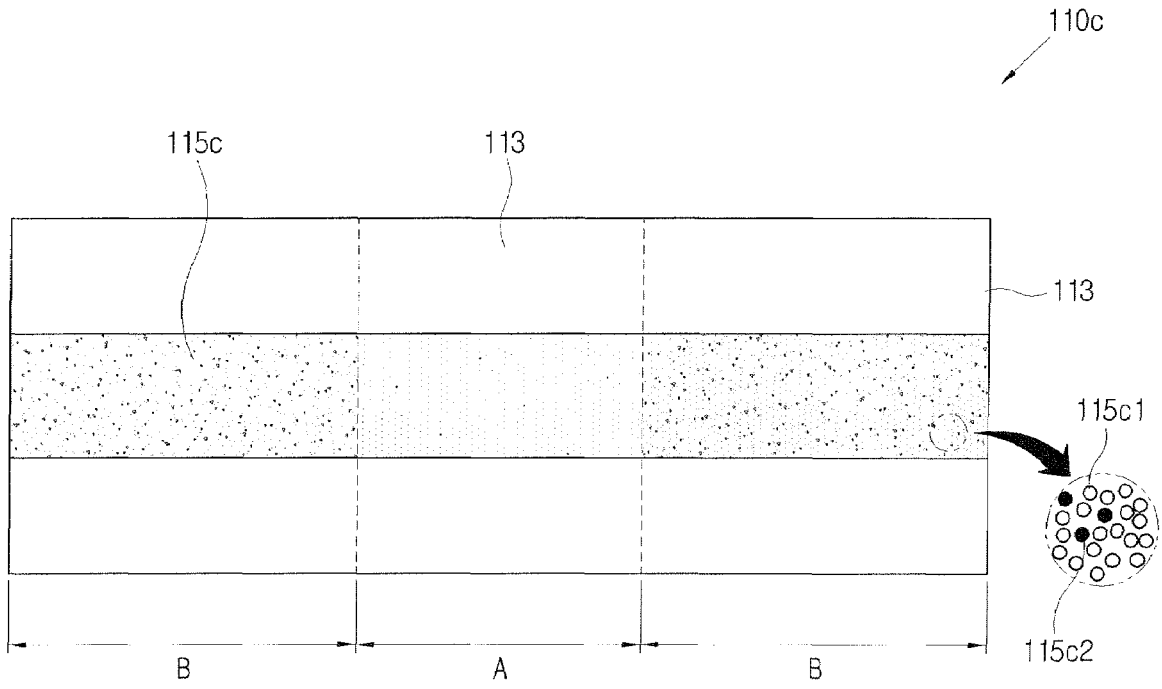
FIG. 10 is a development view of a tubular unit of a heating lamp of a fusing unit according to another embodiment of the present invention.

The fusing unit according to another embodiment of the present invention includes a heating lamp 110*c* illustrated in FIG. 10. The description of the other components will be omitted as they are the same as the embodiment already discussed. A reflecting film 115*c* includes a heat absorption material (or an endothermic material) 115*c*2 which absorbs heat of the heating unit 111 and a reflecting material 115*c* which reflects heat of the heating unit 111.

The reflecting film 115*c* may be formed by coating the heat absorption material 115*c*2 and the reflecting material 115*c*1 after mixing them. Also, the reflecting film 115*c* may be provided so that the ratio of the heat absorption material 115*c*2 with respect to the reflecting material 115*c*1 is different along the lengthwise direction of the tubular unit 113.

Figure 11A:
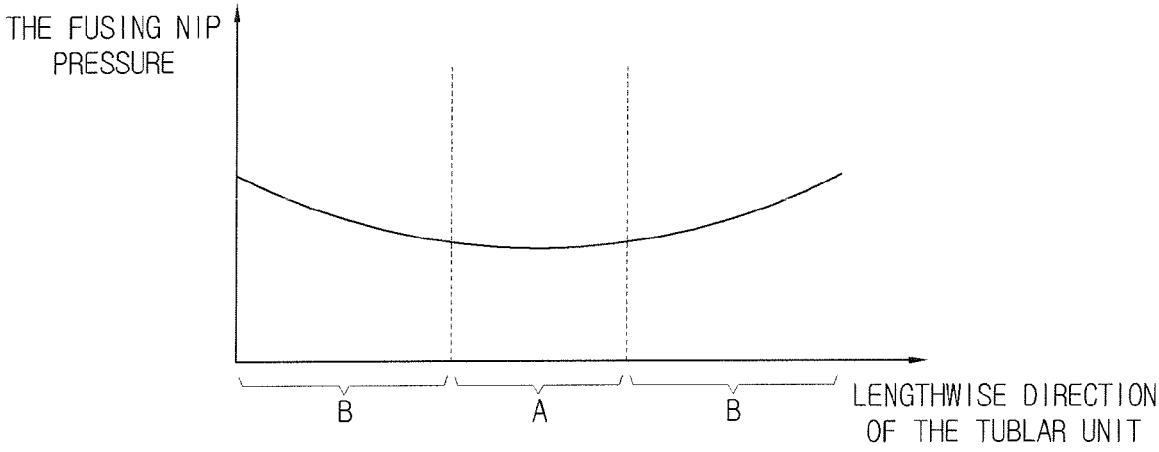
FIGS. 11A-11C are graphs illustrating the pressure of a fusing nip, a heat flux at the fusing nip transmitted from a heating lamp, and their effects on the fixation property along the lengthwise direction of a heating roller of the fusing unit in FIG. 4.
Figure 11B:
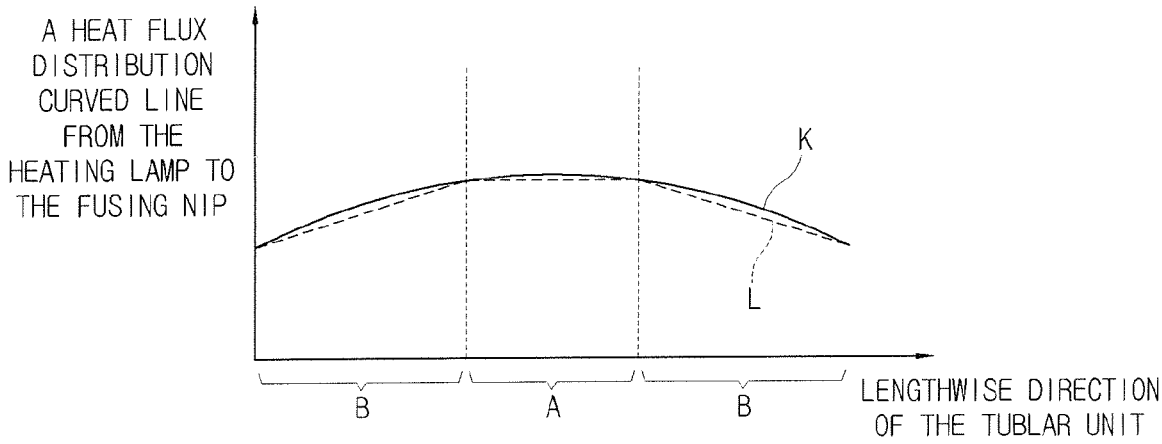

According to the fusing unit illustrated in FIG. 4, the heat flux distribution from the heating lamp 110 to the fusing nip F will be in the shape of a curved line bulged in its center part A, as illustrated in curve line "K" of FIG. 11B.

Also, according to the area pattern of the reflecting film 115*a* illustrated in FIG. 8, the heat flux distribution from the heating lamp 110 to the fusing nip (see F in FIG. 5) will be in the shape of a line L in FIG. 11B. Accordingly, the non-uniform "fusing nip pressure" distribution illustrated in FIG. 11A is complemented and the fixation property of the center part A having a low pressure is improved, and at the same time, the fixation property deviation between the center part A and the opposite end parts B can be decreased.

Figure 11C:
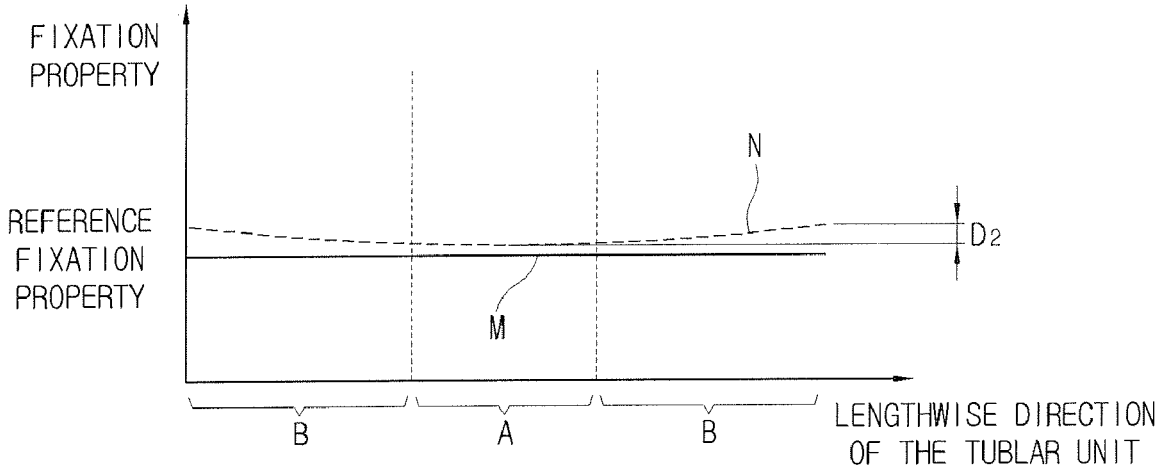

In theory, the fixation property may correspond to the reference fixation along the lengthwise direction like a line M in FIG. 11C, but in reality, an effect caused by the other factors in addition to the heat, temperature and nonlinear characteristics, a pattern approximately like a line N rather than the line M may be formed. Also, the fusing units of FIGS. 9 and 10, can obtain the distribution curved line such as the line N by controlling the thickness of the reflecting film and the content of the heat absorption material. Accordingly, a fusing deviation D2 decreases in comparison with the existing fusing deviation D1, thereby improving printing image quality.

Although noted that the reflectivity ratio along the lengthwise direction is controlled by factors such as area, the thickness of the reflecting films 115, 115*a*, 115*b*, and 115*c*, and the ratio of the heat absorption material, the reflectivity of the heat rays of the tubular unit can be controlled by all these factors, or combinations thereof. That is, the reflectivity can be controlled by properly changing the area and the thickness of the reflecting film 115 at the same time, or by properly changing the area of the reflecting film 115 and the ratio of the heat absorption material at the same time.

Figure 12A:
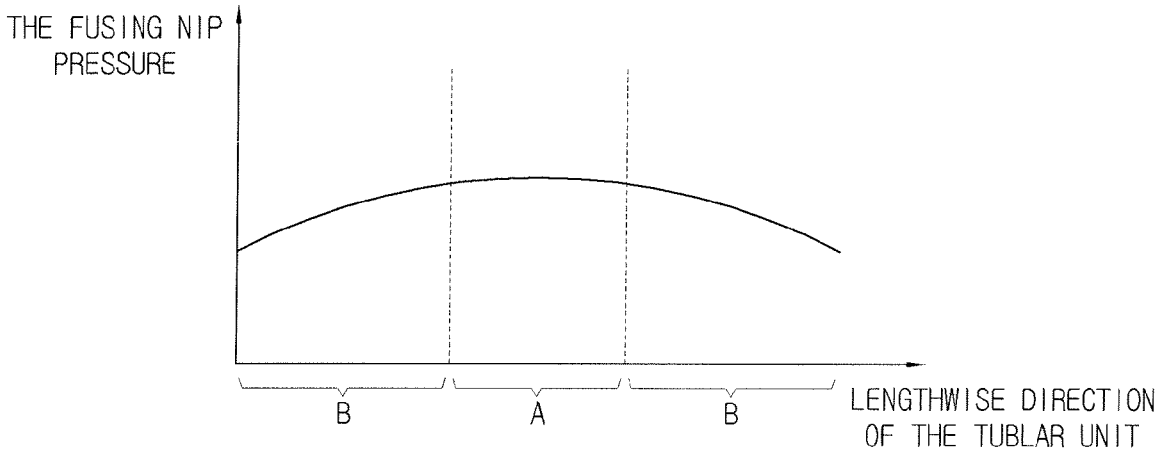
FIGS. 12A-12C are graphs illustrating pressure of a fusing nip, a heat flux at the fusing nip transmitted from a heating lamp, and their effects on the fixation property along the lengthwise direction of the fusing unit according to an embodiment of the present invention.

Meanwhile, as shown in FIG. 12, in a fusing unit (not shown) according to another embodiment of the present invention, pressure distribution of a fusing nip may be provided to be largest in a center part along a lengthwise direction of a heating lamp. For such purpose, a heating roller (not shown) or a pressing roller (not shown) may be provided in a cylindrical shape having a bulged center part A in place of a cylindrical shape having a regular radius along the lengthwise direction. That is, the description of the fusing unit (not shown) having a pressure distribution curved line such as "a fusing nip pressure" illustrated in FIG. 12A will be omitted.

Figure 12B:
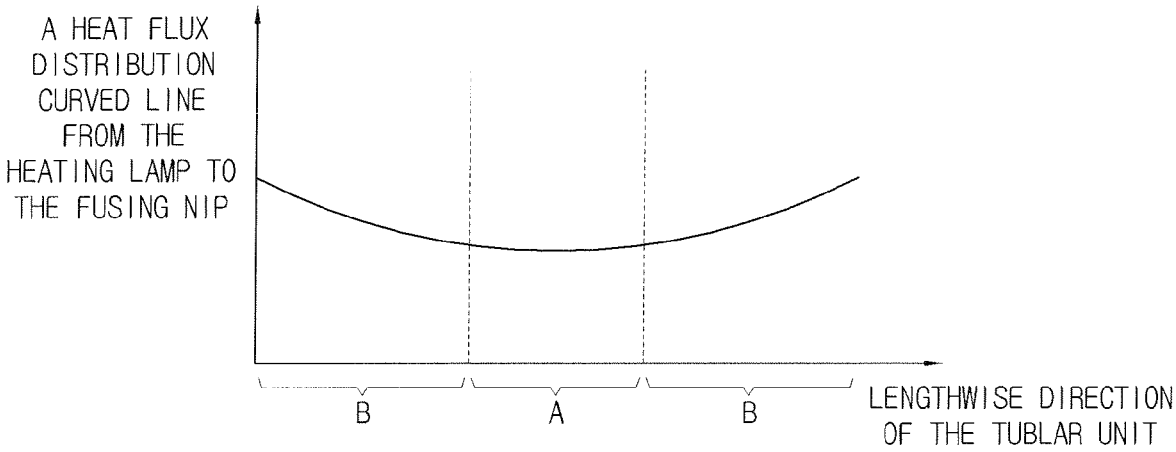
Figure 12C:
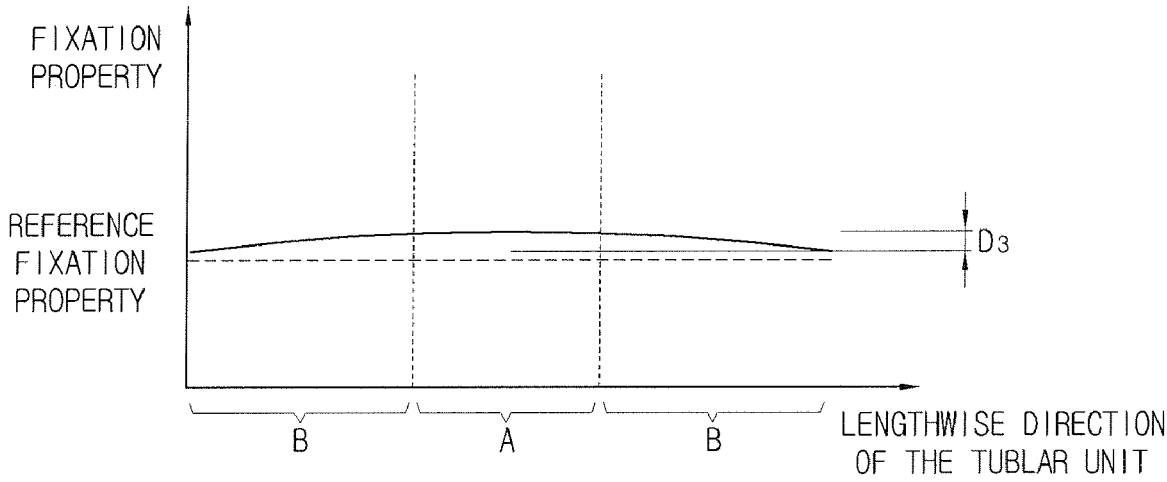

Here, "the fusing nip pressure" distribution illustrated in FIG. 12A can be offset by controlling the reflectivity of the reflecting film. The reflectivity can be controlled to have "a heat flux distribution curved line from the heating lamp to the fusing nip" as shown in FIG. 12B by controlling the area or the thickness of the reflecting film in the heating lamp, or by controlling the content of the heat absorption material. The heat distribution illustrated in FIG. 12B is a heat flux distribution curved line in the shape of a curved line bulged downward at the center part which is contrary to the "heat flux distribution curved line from the heating lamp to the fusing nip" K illustrated in FIG. 11B. Accordingly, as shown in FIG. 12C, in the fusing unit according to another embodiment, the fixation property deviation D3 may be smaller than the fixation property deviation of the conventional fusing unit (see D1 in FIG. 3C).

Meanwhile, the table below denotes a result of a fixation property test of a first page after a cold start in a fusing unit S1 employing a heating lamp without a reflecting film and a fusing unit S2 according to an embodiment of the present invention. The fixation property of the developer of left and right end parts at the lower end parts in the lengthwise direction of the printing medium, a part where the fixation property is the weakest in the printing medium and a center part from the lower right and left end parts has been checked.

| Developer fixation | | Left end part | Centering part | Right end part |
|---|---|---|---|---|
| Cold start | S1 | 86.3% | 69.1% | 85.6% |
| | S2 | 89.8% | 80.1% | 88.8% |

As shown in the above table, the fixation property at the center part in the case S2 is 11% higher than in case S1 that does not have a reflecting film. Also, the fixation property deviation is 16% in S1 which does not include the reflecting film, but the fixation property deviation in the fusing unit according to an embodiment of the present invention is 9%, which represents improved uniformity by 7%. Since the fusing deviation in the case without the reflecting film and the case in which the reflecting film is formed in a uniform pattern are nearly the same, it may be inferred that the improved uniformity of the fixation property is due to the pattern of the reflecting film according to an embodiment of the present invention.

An image forming apparatus according to an embodiment of the present invention illustrated in FIG. 5 includes a fusing unit 100. The image forming apparatus may further include various known components of an electrophotographic image forming apparatus in addition to the fusing unit 100. The image forming apparatus may include a feeding cassette (not shown) which feeds a printing medium inside the image forming apparatus, and a transfer roller (not shown) which transfers the printing medium fed from the feeding cassette to an image forming unit (not shown).

The image forming unit includes a photosensitive drum (not shown) on the surface of which an electrostatic latent image is formed, a laser scanning unit (not shown) which exposes the surface of the photosensitive drum, a developing roller which develops the electrostatic latent image of the photosensitive drum by the developer, and a transferring part which transfers a visible image formed of developer on the surface of the photosensitive drum to the printing medium, such as a paper, a transparency, etc.

The printing medium supplied to the image forming unit by the transfer roller (not shown) passes through the image forming unit which applies a developer onto one side of the printing medium and thereafter, the printing medium is supplied to the fusing unit 100. The fusing unit 100 fuses the developer (see T in FIG. 5) onto the printing medium (see P in FIG. 5). The printing medium is then discharged to the outside of the image forming apparatus.

As described above, the fusing unit and the image forming apparatus have the following benefits.

Since the reflecting ratio can be made to differ along the lengthwise direction of the tubular unit, there is no need to form the reflecting film on the entire tubular unit, thus, making the fusing unit according to an aspect of the present invention, more effective, and less costly.

Also, the reflecting film is formed to differentiate a reflectivity of the reflecting film in a part where the pressure of fusing nip or the heat flux to the developer are relatively small and large, from a part where the pressure of the fusing nip or the heat flux to the developer are relatively large and small, thereby decreasing the fixation property between them. Accordingly, a superior image quality can be obtained.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A fusing unit of an image forming apparatus, comprising:

a heating lamp having a heating unit, and a tubular unit accommodating the heating unit;

a heating roller accommodating the heating lamp; and a pressing roller to be pressed toward the heating roller;

the tubular unit comprising a reflecting film formed on at least one of an external surface and an internal surface thereof so as to have a different reflectivity along a lengthwise direction of the heating unit wherein a reflectivity of the reflecting film is in inverse proportion to a pressure of the pressing roller against the heating roller.

2. The fusing unit of the image forming apparatus according to claim 1, wherein the reflecting film has different thicknesses along the lengthwise direction of the heating unit.

3. The fusing unit of the image forming apparatus according to claim 2, wherein the thickness of the reflecting film is in inverse proportion to a pressure of the pressing roller against the heating roller.

4. The fusing unit of the image forming apparatus according to claim 1, wherein the reflecting film has a different reflecting area along the lengthwise direction of the heating unit.

5. The fusing unit of the image forming apparatus according to claim 4, wherein the reflecting area is in inverse proportion to a pressure of the pressing roller against the heating roller.

6. The fusing unit of the image forming apparatus according to claim 1, wherein the reflecting film comprises a heat absorption material which absorbs heat of the heating unit and a reflecting material which reflects heat of the heating unit, and a ratio of the heat absorption material with respect to the reflecting material is different along the lengthwise direction of the heating unit.

7. The fusing unit of the image forming apparatus according to claim 6, wherein a density of the heat absorption material is in direct proportion to a pressure of the pressing roller against the heating roller.

8. The fusing unit of the image forming apparatus according to claim 1, wherein the reflecting film is formed so that heat rays of the heating unit are reflected toward a part of an inside circumference surface of the heating roller before the part rotates to a position in which the pressing roller and the heating roller are engaged.

9. The fusing unit of the image forming apparatus according to claim 1, wherein the reflecting film is formed by coating a reflecting material.

10. The fusing unit of the image forming apparatus according to claim 1, wherein the reflecting film is thicker at a center part of the tubular unit than at an end part of the tubular unit.

11. The fusing unit of the image forming apparatus according to claim 1, wherein a center part of the heating roller is bulged.

12. The fusing unit of the image forming apparatus according to claim 1, wherein a center part of the pressing roller is bulged.

13. An image forming apparatus, comprising:

an image forming unit which forms an image on a printing medium;

a fusing unit to fuse a developer onto the printing medium, the fusing unit having a heating lamp including a heating unit and a tubular unit accommodating the heating unit, a heating roller accommodating the heating lamp, and a pressing roller to be pressed toward the heating roller; and the tubular unit comprising a reflecting film formed on at least one of an external surface and an internal surface thereof so as to have a different reflecting ratio along a lengthwise direction of the heating unit, wherein a reflectivity of the reflecting film is in inverse proportion to a pressure of the pressing roller against the heating roller.

14. The image forming apparatus according to claim 13, wherein the reflecting film has a different thickness along the lengthwise direction of the heating unit.

15. The image forming apparatus according to claim 14, wherein the thickness of the reflecting film is in inverse proportion to a pressure of the pressing roller against the heating roller.

16. The image forming apparatus according to claim 13, wherein the reflecting film has a different reflecting area along the lengthwise direction of the heating unit.

17. The image forming apparatus according to claim 16, wherein the area of the reflecting film is in inverse proportion to a pressure of the pressing roller against the heating roller.

18. The image forming apparatus according to claim 13, wherein the reflecting film comprises a heat absorption material which absorbs heat of the heating unit and a reflecting material which reflects heat of the heating unit, and a ratio of the heat absorption material with respect to the reflecting material is different along the lengthwise direction of the heating unit.

19. The image forming apparatus according to claim 18, wherein a density of the heat absorption material is in direct proportion to a pressure of the pressing roller against the heating roller.

20. The image forming apparatus according to claim 13, wherein the reflecting film is formed so that the heat rays of the heating unit are reflected toward a part of an inside circumference surface of the heating roller before the part rotates to a position in which the pressing roller and the heating roller are engaged.

21. The image forming apparatus according to claim 13, wherein the reflecting film is formed by coating a reflecting material.

* * * * *